US007501759B2

(12) United States Patent
Han et al.

(10) Patent No.: US 7,501,759 B2
(45) Date of Patent: Mar. 10, 2009

(54) PLASMA DISPLAY PANEL

(75) Inventors: Seong-Hoon Han, Suwon-si (KR); Young-Cheul Kang, Suwon-si (KR); Yoon-Soo Han, Suwon-si (KR); Jung-Hwan Park, Suwon-si (KR); Dong-Min Kim, Suwon-si (KR)

(73) Assignee: Samsung SDI Co., Ltd., Suwon-si, Gyeonggi-do (KR)

( * ) Notice: Subject to any disclaimer, the term of this patent is extended or adjusted under 35 U.S.C. 154(b) by 375 days.

(21) Appl. No.: 11/298,595

(22) Filed: Dec. 12, 2005

(65) Prior Publication Data

US 2006/0125396 A1 Jun. 15, 2006

(30) Foreign Application Priority Data

Dec. 10, 2004 (KR) ..... 10-2004-0104162

(51) Int. Cl.
*H01J 17/49* (2006.01)

(52) U.S. Cl. ..... 313/582; 313/583; 313/584; 313/585

(58) Field of Classification Search ..... 313/582–587, 313/292, 238; 445/23–25; 345/37, 60; 315/169.4
See application file for complete search history.

(56) References Cited

U.S. PATENT DOCUMENTS

| | | | |
|---|---|---|---|
| 6,465,956 | B1 | 10/2002 | Koshio et al. |
| 6,855,026 | B2 | 2/2005 | Fujinaga et al. |
| 6,977,467 | B2 | 12/2005 | Kawanishi |
| 7,015,645 | B2 | 3/2006 | Kim et al. |
| 7,154,222 | B2 | 12/2006 | Woo et al. |
| 2004/0046505 | A1 | 3/2004 | Kawanishi |
| 2004/0201351 | A1 | 10/2004 | Woo et al. |
| 2005/0017639 | A1 | 1/2005 | Ikarashi |

FOREIGN PATENT DOCUMENTS

| | | |
|---|---|---|
| EP | 1 388 876 | 2/2004 |
| JP | 2000-340123 | 12/2000 |
| JP | 2001-135240 | 5/2001 |
| JP | 2004-103249 | 4/2004 |
| JP | 2004-103419 | 4/2004 |
| JP | 2004-103562 | 4/2004 |
| JP | 2004-319486 | 11/2004 |
| KR | 10-2004-0023771 A | 3/2004 |
| WO | WO 02/084689 A1 | 10/2002 |

*Primary Examiner*—Joseph L Williams
*Assistant Examiner*—Elmito Breval
(74) *Attorney, Agent, or Firm*—Lee & Morse, P.C.

(57) ABSTRACT

A plasma display panel including a front substrate, a rear substrate, a display area, a non-display area including a dummy region, and a plurality of rib members is provided. The dummy region includes a first barrier rib region extending along a first direction and including portions of at least some of the plurality of barrier rib members, a second barrier rib region extending along a second direction and including portions of at least some of the plurality of barrier rib members, and at least one sector region. The sector region includes at least one sector barrier rib member extending along a direction other than the first direction and the second direction and connecting at least one portion of at least one of the barrier rib portions in the first barrier rib region to at least one of the barrier rib portions in the second barrier rib region.

19 Claims, 9 Drawing Sheets

PLASMA DISPLAY PANEL

BACKGROUND OF THE INVENTION

1. Field of the Invention

The invention relates to a plasma display panel. More particularly, the invention relates to a plasma display panel having a dummy barrier rib with an improved structure in a non-display area that reduces and/or prevents bending of an outer portion and/or end portion of the dummy barrier to help reduce and/or prevent noise during operation of the plasma display panel.

2. Description of the Related Art

Plasma display panels (PDPs) are flat panel display devices that excite phosphors in vacuum discharge cells with ultraviolet (VUV) rays generated by discharge of gas in the discharge cells. PDPs may be used to provide wide screen display devices. In particular, PDPs may be used to provide wide large screen display devices with high resolution.

In PDPs, discharge cells may be partitioned by barrier ribs disposed, for example, in a stripe or lattice-type arrangement in a space between a front substrate and a rear substrate. The barrier ribs may define discharge cells in a display area and may define dummy cells in a non-display area. The non-display area may surround the display area to help ensure stable discharge of outer ones of the discharge cells in the display area. A barrier rib forming such a dummy cell may be called a dummy barrier rib.

Barrier ribs are generally formed from a barrier rib layer made from a paste. The barrier rib layer may be patterned by a sandblast method, a press method, or an etching method using a photosensitive material. The barrier ribs may then be baked at a temperature of 450° C. or more to remove binders and impurities included in the paste to help increase the strength of the barrier ribs.

When the barrier ribs are baked, one or more components of the paste used to form the barrier rib layer may vaporize and other components of the barrier rib layer may combine with each other. As a result of the vaporization and/or combining of the components during baking, the resulting barrier rib may be smaller than the corresponding portion of the resulting patterned barrier ribs. As a result of such shrinking during baking, the outer and/or end portions of the barrier ribs may not be strong enough to maintain their form, and the outer portions and/or the end portions of the barrier ribs may bend or deform. In particular, as a result of the baking, the end portions or the outermost portions of the barrier rib may bend upward and/or inward toward respective inner portions of the barrier ribs.

More particularly, in known barrier rib patterns and structures, end portions of the barrier ribs are more susceptible to bending and deforming than other portions (e.g., inner portions) of the barrier ribs because the inner portions of the barrier ribs generally tend to have substantially uniform strength. Thus, in known barrier rib patterns and structures, a bottom side of the end portion of the barrier rib may detach from a dielectric layer, thereby bending the end portion of the barrier rib.

As a result of such bending or deforming, the outermost portions or the end portions of the barrier ribs may have top portions that are farther from or at a greater height relative to a substrate than top portions of, for example, other portions of the barrier ribs. As a result, as shown in FIG. 8, a gap (marked by a circle in FIG. 8) may be generated between a front substrate 100 and a barrier rib 110. Such a gap may cause noise from vibration that may occur, for example, when the PDP is driven.

The above information disclosed in this Background section is only provided to aid in the understanding of one or more aspects of the invention detailed below, and is not to be considered nor construed as constituting prior art.

SUMMARY OF THE INVENTION

The invention is therefore directed to improved barrier ribs for plasma display apparatuses, which substantially overcome one or more of the problems due to the limitations and disadvantages of the related art.

It is therefore a feature of an embodiment of the invention to provide a dummy barrier rib with an improved structure in a non-display area of a plasma display apparatus that reduces and/or prevents bending of an outer portion and/or end portion of the dummy barrier to help reduce and/or prevent noise during driving of the plasma display apparatus.

It is therefore another feature of the present invention to provide a plasma display panel having improved height uniformity of a barrier rib by suppressing shape variations of a barrier rib that may result from baking.

It is therefore yet another feature of the present invention to provide a plasma display panel that reduces and/or prevents a gap from forming between the barrier rib and a substrate.

It is therefore still another feature of the present invention to provide a plasma display panel having a barrier rib that reduces and/or prevents noise during operation of the plasma display panel.

At least one of the above and other features and advantages of the present invention may be realized by providing a plasma display panel that may include a front substrate and a rear substrate disposed to be facing each other, a plurality of address electrodes and a plurality of display electrodes formed in a space between the front substrate and the rear substrate, a display area for forming an image, a non-display area around the display area and a plurality of barrier rib members. The address electrodes and the display electrodes may be arranged to cross each other. The non-display area may include a dummy region. Each barrier rib member may extend across at least one of the display area and the non-display area. The plurality of barrier rib members may include first barrier rib members and second barrier rib members. The first barrier rib members may extend along a first direction and the second barrier rib members may extend along a second direction that crosses the first direction.

The first barrier rib members and the second barrier rib members may partition the space between the front substrate and the rear substrate and define a plurality of discharge cells in the display area and a plurality of dummy cells in the dummy region. The dummy region may include at least one first barrier rib region that may extend along the first direction and may include portions of at least some of the plurality of barrier rib members, at least one second barrier rib region that may extend along the second direction and may include portions of at least some of the plurality of barrier rib members and at least one sector region. The sector region may include at least one sector barrier rib member that extends along a direction other than the first direction and the second direction and connects at least one portion of at least one of the barrier rib portions in the first barrier rib region to at least one of the barrier rib portions in the second barrier rib region.

The at least one sector barrier rib may be an arc-shaped sector barrier rib member that extends along a curve formed by points that are a predetermined distance away from a point where the first barrier rib region and the second barrier rib region intersect. The sector region may further include a radial barrier rib member that linearly extends from the point where the first barrier rib region and the second barrier rib region intersect to one of the points on the curve defining the arc-shaped sector barrier rib member. In embodiments of the invention, the first direction may perpendicular to the second direction and the radial barrier rib member may bisect an angle formed by the intersection of the first barrier rib region and the second barrier rib region.

The sector region may include a plurality of arc-shaped sector barrier rib members, and a first predetermined space may exist between adjacent ones of the arc-shaped sector barrier rib members. The plasma display panel may further include at least one inter-rib barrier rib member linearly extending between and connecting adjacent arc-shaped ones of the sector barrier rib members. A number of inter-rib barrier rib members respectively disposed between an outermost one of the of the arc-shaped sector barrier rib members and a first adjacent one of the plurality of arc-shaped sector barrier rib members may be greater than a number of inter-rib barrier rib members disposed between other respective adjacent ones of the plurality of arc-shaped sector barrier rib members. A width of the inter-rib barrier rib member may be less than a width of the arc-shaped sector barrier rib members.

A distance between an outermost one of the arc-shaped sector barrier rib members and a first adjacent one of the plurality of arc-shaped sector barrier rib members may be less than a distance between the intersection point of the first barrier rib region and the second barrier rib region and a second adjacent one of the plurality of arc-shaped barrier rib members, where the first adjacent one of the plurality of arc-shaped barrier rib members is a closest one of the plurality of arc-shaped sector barrier rib members to the outermost one of the arc-shaped sector barrier rib members and the second adjacent one of the plurality of arc-shaped barrier ribs is a closest one of the plurality of arc-shaped sector barrier rib members to the intersection of the first barrier rib region and the second barrier rib region.

Each of the sector regions may be defined by a first linear portion and a second linear portion and the first linear portion may correspond to where respective ends of the portions of the plurality of barrier rib members in the first barrier rib region continuously connect to an end of the at least one sector barrier rib member extending along the direction other than the first direction and the second direction and the second linear portion may correspond to where respective ends of the portions of the plurality of barrier rib members in the second barrier rib region continuously connect to another end of the at least one sector barrier rib member.

In embodiments of the invention, the first direction may extend horizontally and the second direction may extend vertically, and the first barrier rib region may include at least three first barrier rib members extending horizontally therein such that at least one of the first barrier rib members may be provided between an outermost horizontally extending one of the plurality of first barrier rib members and an innermost horizontally extending one of the plurality of first barrier rib members, and a shortest distance exists between the outermost first barrier rib member and the first barrier rib member adjacent thereto and a greatest distance exists between the innermost first barrier rib member and the first barrier rib member adjacent thereto, in relation to respective distances between adjacent ones of the first barrier rib members. A width of the outermost first barrier rib member may be greater than a width of the first barrier rib member adjacent thereto.

In embodiments of the invention, a width of the second barrier rib members extending vertically in the first barrier rib region and crossing the outermost first barrier rib member may be less than the width of the outermost first barrier rib member.

In embodiments of the invention, the first direction may extend horizontally and the second direction may extend vertically, and the second barrier rib region may include at least three second barrier rib members extending vertically therein such that at least one of the second barrier rib members may be provided between an outermost vertically extending one of the plurality of second barrier rib members and an innermost vertically extending one of the plurality of second barrier rib members, and a shortest distance exists between the outermost second barrier rib member and the second barrier rib member adjacent thereto and a greatest distance exists between the innermost second barrier rib member and the second barrier rib member adjacent thereto, in relation to respective distances between adjacent ones of the second barrier rib members.

A width of the outermost vertical barrier rib member may be greater than a width of the second barrier rib member adjacent thereto. A width of the first barrier rib members that extend horizontally in the second barrier rib region and cross the outermost vertical barrier rib member may be less than a width of the outermost second barrier rib member. The at least one sector barrier rib member may be an arc-shaped sector barrier rib member and an end of the arc-shaped sector barrier rib member may continuously extend and connect to one of the first barrier rib members linearly extending horizontally in the first barrier rib region and another end of the arc-shaped sector barrier rib member may continuously extend and connect to one of the second barrier rib members linearly extending vertically in the second barrier rib region.

The arc-shaped sector barrier rib member may be an outermost one of the sector barrier rib members and may be continuously connected to an outermost one of the first barrier rib members of the first barrier rib region. At least one radial rib member may continuously extend from at least one of the first barrier rib members and the second barrier rib members along a direction other than the first and second directions, and the radial rib member may continuously and linearly extend from and between the point where the first barrier rib region and the second barrier rib region intersect and the arc-shaped barrier rib member.

BRIEF DESCRIPTION OF THE DRAWINGS

The above and other features and advantages of the present invention will become more apparent to those of ordinary skill in the art by describing in detail exemplary embodiments thereof with reference to the attached drawings in which.

DETAILED DESCRIPTION OF THE INVENTION

Figure 1:
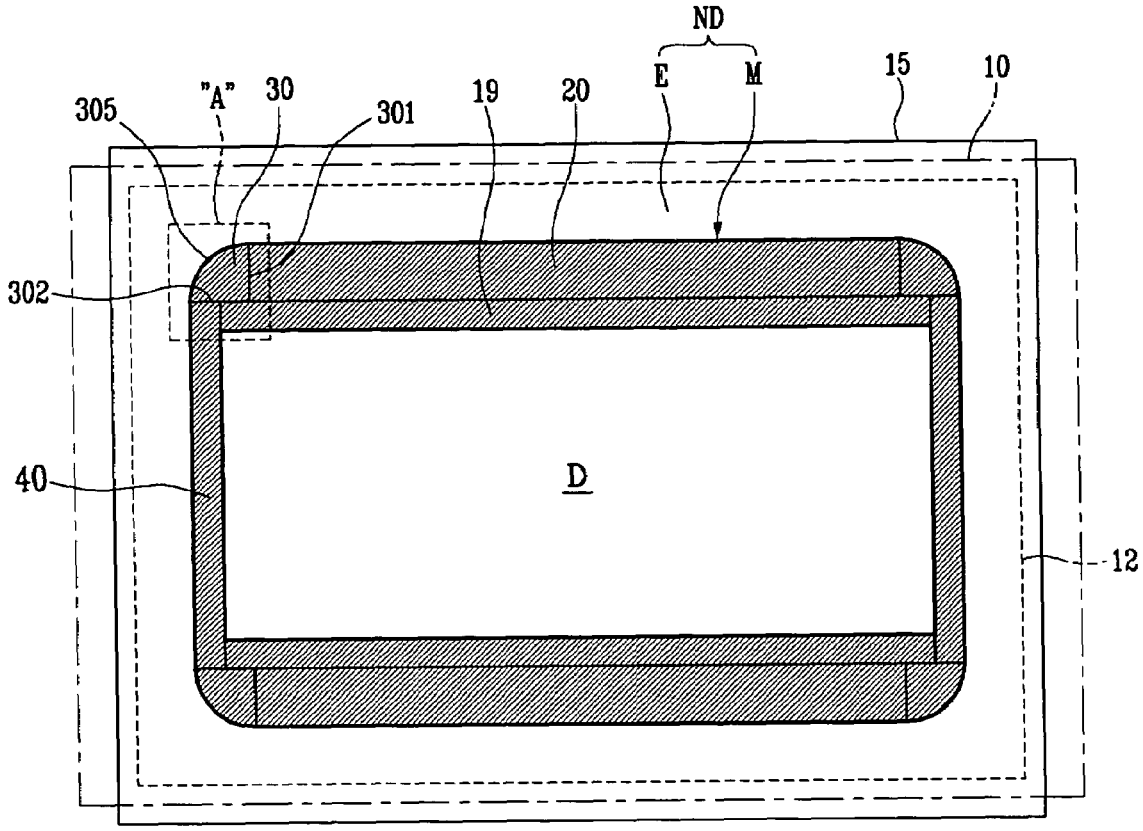
FIG. 1 illustrates a top plan view of a plasma display panel (PDP) according to an exemplary embodiment of the present invention.

Korean Patent Application No. 10-2004-0104162, filed on Dec. 10, 2004, in the Korean Intellectual Property Office, and entitled, "Plasma Display Panel," is incorporated by reference herein in its entirety.

The present invention will now be described more fully hereinafter with reference to the accompanying drawings, in which exemplary embodiments of the invention are shown. The invention may, however, be embodied in different forms and should not be construed as limited to the embodiments set forth herein. Rather, these embodiments are provided so that this disclosure will be thorough and complete, and will fully convey the scope of the invention to those skilled in the art. In the figures, the dimensions of layers and regions are exaggerated for clarity of illustration. It will also be understood that when a layer is referred to as being "on" another layer or substrate, it can be directly on the other layer or substrate, or intervening layers may also be present. Further, it will be understood that when a layer is referred to as being "under" another layer, it can be directly under, and one or more intervening layers may also be present. In addition, it will also be understood that when a layer is referred to as being "between" two layers, it can be the only layer between the two layers, or one or more intervening layers may also be present. Although reference may be made to a vertical direction and a horizontal direction, such identifications are only intended to aid in the understanding one or more aspects of the invention described herein and are not, in any way intended as limiting the features to such directions. Like reference numerals refer to like elements throughout.

Figure 2:
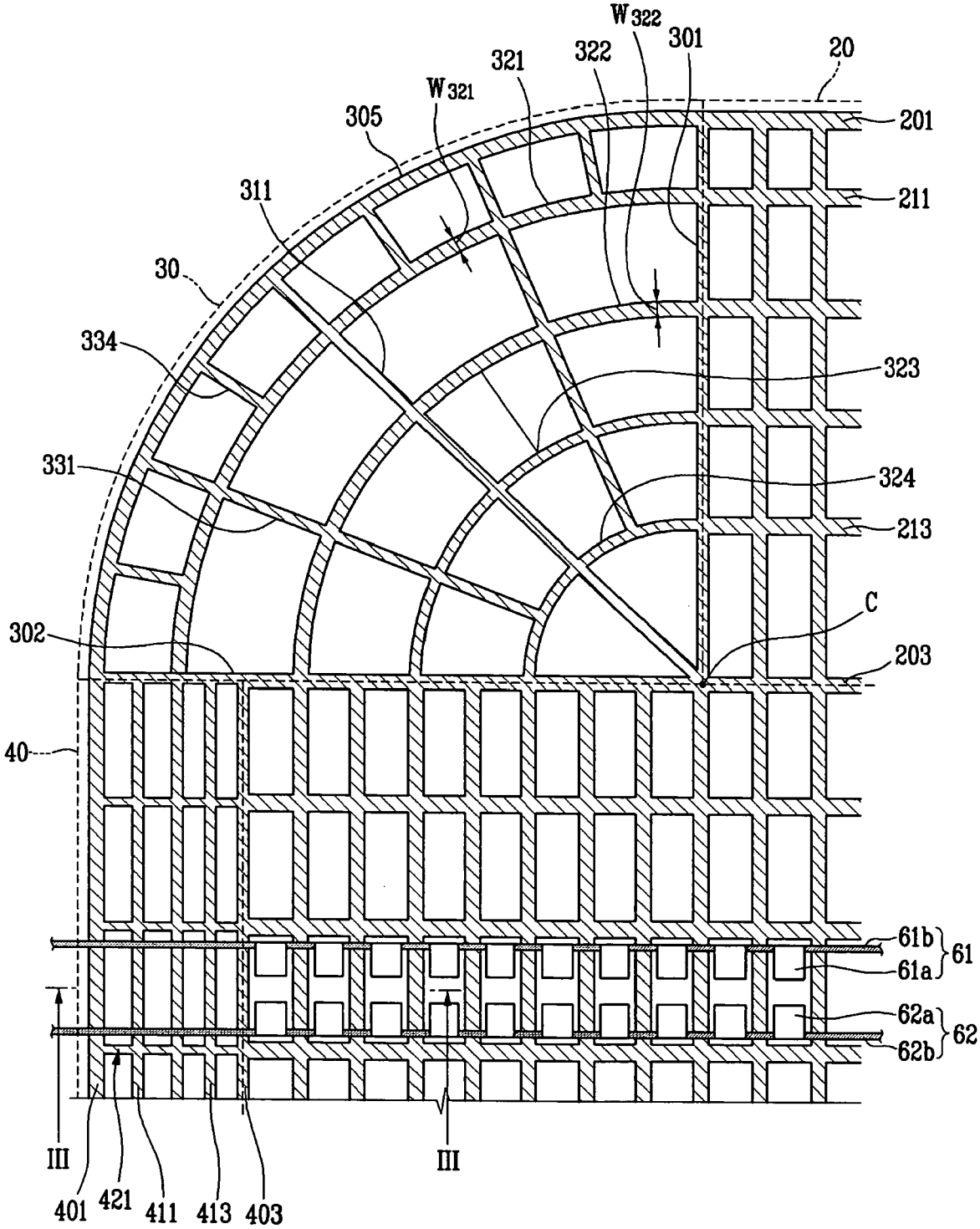
FIG. 2 illustrates an enlarged top plan view of portion "A" of the PDP shown in FIG. 1.

FIG. 1 illustrates a top plan view of a plasma display panel (PDP) according to an exemplary embodiment of the invention. FIG. 2 illustrates a top plan view of enlarged portion "A" of the PDP shown in FIG. 1.

As shown in FIG. 1 and FIG. 2, the PDP may include a front substrate 10 and a rear substrate 15 disposed facing each other with a space therebetween. The PDP may include a display area D for displaying images by emitting visible light and a non-display area. The non-display area ND may be formed around edges of the display area D. In some embodiments of the invention, the non-display area ND may be formed only beyond an outer boundary of the display area D. In some embodiments of the invention, the non-display area ND may be formed completely around an outer boundary of the display area D.

Figure 3:
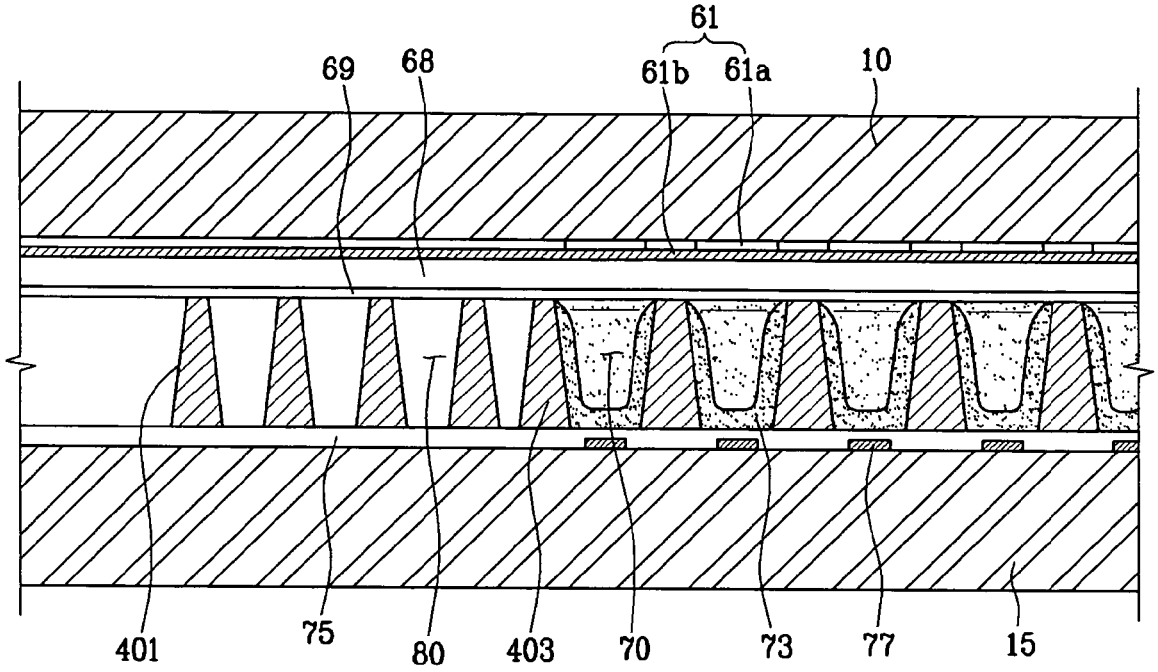
FIG. 3 illustrates a partial sectional view of the enlarged portion along line III-III shown in FIG. 2.

The space between the front substrate 10 and the rear substrate 15 may be partitioned by barrier ribs forming a plurality of discharge cells 70 and dummy barrier ribs forming a plurality of dummy cells 80, as shown in FIG. 3. The display area D may include the plurality of discharge cells. The non-display area ND may include a dummy region M and a marginal region E. The dummy region M may include the dummy cells 80 that are defined by dummy barrier ribs. The dummy barrier ribs may continuously extend from the barrier ribs formed in the display area D. In the following description, barrier ribs formed in the display area D and dummy barrier ribs formed in the non-display area ND may be generally referred to as "barrier ribs". The marginal region E may be provided at outer sides of the dummy region M and may correspond to a space between the outer boundary of the dummy region M and a connecting portion 12 where the front substrate 10 is connected to the rear substrate 15.

The dummy region M may include sector region(s) 30, first barrier rib region(s) 20 and second barrier rib region(s) 40. In embodiments of the invention, some or all of the sector regions 30, the first barrier rib regions 20 and the second barrier rib regions 40 may be continuously formed or connected. The sector regions 30 may be arranged around corners of the display area D. The sector regions 30 may be arranged between different barrier rib regions. For example, one of the sector regions 30 may be arranged between one of the first barrier rib regions 20 and one of the second barrier rib regions 40. In embodiments of the invention, the sector region(s) 30 may serve as transition regions that continuously connect barrier ribs of the different barrier rib regions together.

In embodiments of the invention, the first barrier rib region 20 may be arranged to extend along a direction that is perpendicular or substantially perpendicular to a direction along which the vertical barrier rib region 40 extends. For example, the first barrier rib region 20 may extend along the horizontal direction and the second barrier rib region 40 may extend along the vertical direction. In the following description, the vertical direction is perpendicular to or substantially perpendicular to the horizontal direction, as shown in FIG. 1. In embodiments of the invention, the PDP may include a plurality of horizontally extending barrier ribs and a plurality of vertically extending barrier ribs. In such embodiments, for example, the first barrier ribs may correspond to portions of the horizontally extending barrier ribs in the first barrier rib region and the second barrier ribs may correspond to portions of the vertically extending barrier ribs in the second barrier rib region.

The dummy region M may include a buffer barrier rib region 19 formed between the display area D and one or more of the barrier rib regions. For example, as shown in FIG. 1, the buffer barrier rib region 19 may be formed between the display area D and the first barrier rib region 20. The buffer barrier rib region 19 may be formed between the display area D and the sector regions 30.

As shown in FIG. 1, the sector regions 30 may be defined by a first portion 301, a second portion 302 and an outer portion 305. The first portion 301 and the second portion 302 may each be a linear portion or boundary. The first portion 301 may cross or intersect the second portion 302. For example, the first portion(s) 301 may extend along a first direction and the second portion(s) 302 may extend along a second direction, where the first direction is perpendicular to or substantially perpendicular to the second direction.

The outer portion(s) 305 may connect respective outer end portions of the first portion(s) 301 and the second portion(s) 302. In embodiments, the outer portion 305 may be an arc-shaped portion. The first barrier rib region 20 may be adjacent to the first portion 301, and the second barrier rib region 40 may be adjacent to the second portion 302 of the sector region 30. More particularly, in embodiments of the invention, the first barrier rib region 20 may be arranged between facing first portions 301 of respective sector regions 30 and the second barrier rib regions 40 may be arranged between facing second portions 302 of respective sector regions 30. Each of the outer portions 305 may connect an outer edge portion of the first portion 301 with an outer edge portion of the second portions 302 of a respective one of the sector regions 30.

More particularly, in embodiments of the invention, the first portion 301 may correspond to an edge of the first barrier rib region 20 and the second portion 302 may correspond to an edge of the second barrier rib region 40. As discussed above, although reference may be made, for example, to an edge of the first barrier rib region 20 or an edge of the second barrier rib region 40, in embodiments of the invention, respective portions of the sector region(s) 30 may be continuously formed or connected to the first barrier rib region(s) 20 and the second barrier rib region(s) 40. In such embodiments of the invention, the respective "edges" may merely correspond, for example, to the boundaries where the respective regions end and not where the respective barrier ribs end. For example, in embodiments of the invention where the first barrier rib region 20 including, for example, horizontally aligned barrier ribs, the second barrier rib region 40 including, for example, vertically aligned barrier ribs and the sector region 30 including, for example, curved barrier ribs are continuously formed, the first portion 301 of the sector region 30 may correspond to a boundary where the horizontally aligned barrier ribs of the first barrier rib region 20 begin to diverge from a horizontal plane and begin to extend at a different angle.

The outer portion 305 of each of the sector regions 30 may correspond to a boundary defined by a constant distance from a crossing point C where respective portions of the first portion 301 and the second portion 302 intersect. In embodiments of the invention, the sector region 30 may be shaped like a quarter of a circle and may fill at least a portion of the space between the first portion 301 and the second portion 302.

In embodiments of the invention, the sector regions 30 may completely occupy a space at least partially defined by respective ones of the first barrier rib regions 20 and respective ones the second barrier rib regions 40. For example, as shown in FIG. 1, the sector regions 30 occupy a gap between respective portions of the first barrier rib region 20 and the second barrier rib regions 40 such that at least some of the barrier ribs in the dummy region M continuously extend, in some form, around a corner of and/or around the display. In embodiments of the invention, the sector regions help reduce and/or prevent open ended barrier ribs and/or barrier rib regions.

As shown in FIG. 2, a first sector barrier rib member 311 may be provided in the sector region 30 of the dummy region M. The first sector barrier rib member 311 may linearly extend to the outer portion 305 from the crossing point C of the first portion 301 and the second portion 302. The first sector barrier rib members 311 may extend only along a portion of a linear path between the outer portion 305 and the crossing point C. The first sector barrier rib member 311 may be a radial barrier rib member extending from the crossing point C to the outer portion 305. The first barrier rib member 311 may bisect an angle formed by and between the first portion 301 and the second portion 302. An angle formed between the first sector barrier rib member 311 and the first portion 301 or the second portion 302 may be 45° when the first portion 301 and the second portion 302 are perpendicular to each other.

Second sector barrier rib members 321, 322, 323, and 324 may be formed in the sector region 30 of the dummy region M. The respective second sector barrier rib members 321, 322, 323, 324 may connect respective portions of the first portion 301 and second portion 302. The second sector barrier rib members 321, 322, 323, 324 may have arc-like shapes. In the embodiments of the invention, one or more second sector barrier rib members (e.g., 321, 322, 323, and 324) may be provided between the outer portion 305 and the crossing point C. In embodiments of the invention employing a plurality of second sector barrier ribs (e.g., 321, 322, 323, 324), distances between respective adjacent ones of the second sector barrier rib members 321, 322, 323, 324 may be the same or different.

As shown in FIG. 2, for example, a distance between the outer portion 305 and its adjacent second sector barrier rib member 321 may be different than a distance between each of respective adjacent second sector barrier rib members 321, 322, 323, and 324 or between the second sector barrier rib member 324 that is closest to the crossing point C and the crossing point C. In embodiments of the invention, a distance between the outer portion 305 and the respective adjacent second sector barrier rib member 321 may be the smallest and a distance between the crossing point C and its adjacent second sector barrier rib member 324 may be the greatest. The second sector barrier rib members 321, 322, 323 and 324 may be connected to respective barrier rib members of the first barrier rib region 20 and the second barrier rib region 40. In embodiments of the invention, the second sector barrier rib members 321, 322, 323 and 324 may extend from respective barrier rib members of the first barrier rib region 20 and the second barrier rib region 40.

As shown in FIG. 2, inter-rib barrier rib members 331 and 334 may be provided in the sector region 30 of the dummy region M. The inter-rib barrier rib members 331 and 334 may linearly extend over the second sector barrier rib members 321, 322, 323, and 324 from the outer portion 305. In embodiments of the invention, a width of the inter-rib barrier rib members 331 and 334 may be less than a width of the second sector barrier rib members 321, 322, 323, and 324. In the following description, a width of a barrier rib member may be defined as a shorter distance along which a top portion of a barrier rib member extends, as shown for example, with regard to the second sector barrier rib members 321 and 322 in FIG. 2 as $W_{321}$ and $W_{322}$, respectively.

The inter-rib barrier rib members 331 and 334 may divide the second sector barrier rib members 321, 322, 323, and 324 at the same or different intervals. In embodiments of the invention, the number of the inter-rib barrier rib members 334 provided between the outer portion 305 and its adjacent second sector barrier rib member 321 may be greater than the number of inter-rib barrier rib members 331 respectively provided between adjacent second sector barrier rib members 321, 322, 323, and 324.

As discussed above, the first portion 301 and the second portion 302 of the sector region 30 in the dummy region M may be respectively shared by the first and second barrier rib regions 20 and 40. The sector region 30 and first barrier rib region 20 may be divided by the first portion 301. The sector region 30 and the second barrier rib region 40 may be divided by the second portion 302.

The first barrier rib region 20 may include a plurality of dummy cells partitioned by the first barrier rib members and crossing ones of the other barrier rib members. The crossing barrier rib members may be arranged parallel to each other and may extend perpendicularly or substantially perpendicularly to the first barrier rib members. These crossing barrier rib members may correspond to barrier rib portions extending from end portions of barrier ribs defining discharge cells of the display portion D of the PDP. As shown in FIG. 2, at least one first barrier rib member (e.g., 211) may be formed between an outermost one of the first barrier rib members 201 and an innermost one of the first barrier rib members 203 of the first barrier rib region 20. A plurality (e.g., four) first barrier rib members may be formed in embodiments of the invention. In the exemplary embodiment of the invention illustrated in FIG. 2, a distance between the outermost first barrier rib member 201 and its adjacent first barrier rib member 211 may be the shortest, and a distance between the innermost first barrier rib member 203 and its adjacent first barrier rib member 213 may be the greatest.

The second barrier rib region 40 may include a plurality of dummy cells partitioned by the second barrier rib members and crossing ones of other barrier rib members. The crossing barrier rib members may be arranged parallel to each other and may extend perpendicularly or substantially perpendicularly to the second barrier rib members. These crossing barrier rib members may correspond to barrier rib portions extending from end portions of barrier ribs defining discharge cells of the display portion D of the PDP. In embodiments of the invention, at least one second barrier rib member may be formed between an outermost second barrier rib member 401 and an innermost second barrier rib member 403 of the second barrier rib region 40. In embodiments of the invention, a plurality (e.g., three) of second barrier rib members may be formed. In the exemplary embodiment of the invention illustrated in FIG. 2, a distance between the outermost second barrier rib member 401 and its adjacent second barrier rib member 411 may be the greatest, and a distance between the innermost second barrier rib member 403 and its adjacent second barrier rib member 413 may be the shortest. In embodiments of the invention, the outermost second barrier rib member 401 of the second barrier rib region 40 may have a width that is greater than a width of its adjacent second barrier rib member 411.

In embodiments of the invention, a width of a first barrier rib member 421 crossing an outermost second barrier rib member 401 may be smaller than a width of the outermost second barrier rib member 401.

In embodiments of the invention, a width of the first barrier rib members (e.g., 421) may be set to be relatively smaller than widths of adjacent barrier ribs (e.g., 411) to reduce an attraction force between barrier rib members toward the inner side of the panel. By making a width of the first barrier ribs (e.g., 421) smaller than, for example, a width of the outermost second barrier rib member 401, it is possible to help the second barrier rib member 401 of the second barrier rib region 40 resist the attraction force and thereby reduce and/or prevent the outer end portion of the barrier ribs from bending.

The outer portion 305 of the sector region 30 in the dummy region M may have one side connected along its elongation direction to the outermost first barrier rib member 201 of the first barrier rib region 20. The outermost first barrier rib member 201 of the first barrier rib region 20 may be linearly formed.

In embodiments of the invention, the outer portion 305 of the sector region 30 in the dummy region M may be connected to the outermost second barrier rib member 401 of the second barrier rib region 40. By connecting the outermost first barrier rib member 201 and the outermost second barrier rib member 401, as discussed above in relation to FIG. 2, it is possible to further reduce and/or prevent the end portions of the barrier ribs from bending and/or deforming.

FIG. 3 is a partial sectional view of the PDP shown in FIG. 1, along line III-III of FIG. 2. As shown in FIG. 3, the front substrate 10 and the rear substrate 15 of the PDP may face each other with a predetermined gap therebetween. The space between the front and rear substrates 10 and 15 may be partitioned into the plurality of discharge cells 70, as discussed above. The plurality of discharge cells 70 may emit visible light by employing an independent discharging mechanism, respectively, to realize a predetermined image.

On the rear substrate 15, address electrodes 77 may be formed along one direction, and a dielectric layer 75 may be formed on the rear substrate 15. The dielectric layer 75 may cover the address electrodes 77. As described above, the barrier ribs may be disposed in a predetermined pattern on the dielectric layer 75 and may form the discharge cells 70 and the dummy cells 80. Each pixel may include three discharge cells 70 respectively including red, green, and blue phosphor layers.

Display electrodes 61 and 62 may be formed on one side of the front substrate 10 along another direction that crosses the direction along which the address electrodes 77 extend. The display electrodes 61 and 62 may be provided as pairs. The display electrodes 61 and 62 may face each other and may respectively form a discharge gap associated with each discharge cell 70. The respective display electrodes 61 and 62 may be formed of transparent electrodes 61*a* and 62*a* may form a discharge gap and bus electrodes 61*b* and 62*b* may be provided as a metal electrode to aid the electrical conductivity of the transparent electrodes 61*a* and 62*a*. In embodiments, the display electrodes may be formed with only a metal electrode and may be provided in different shapes than those shown in FIG. 3.

A dielectric layer 68 that covers the display electrodes 61 and 62 may be formed. An MgO protective layer 69 may be formed on the dielectric layer 68 for protection.

Figure 4:
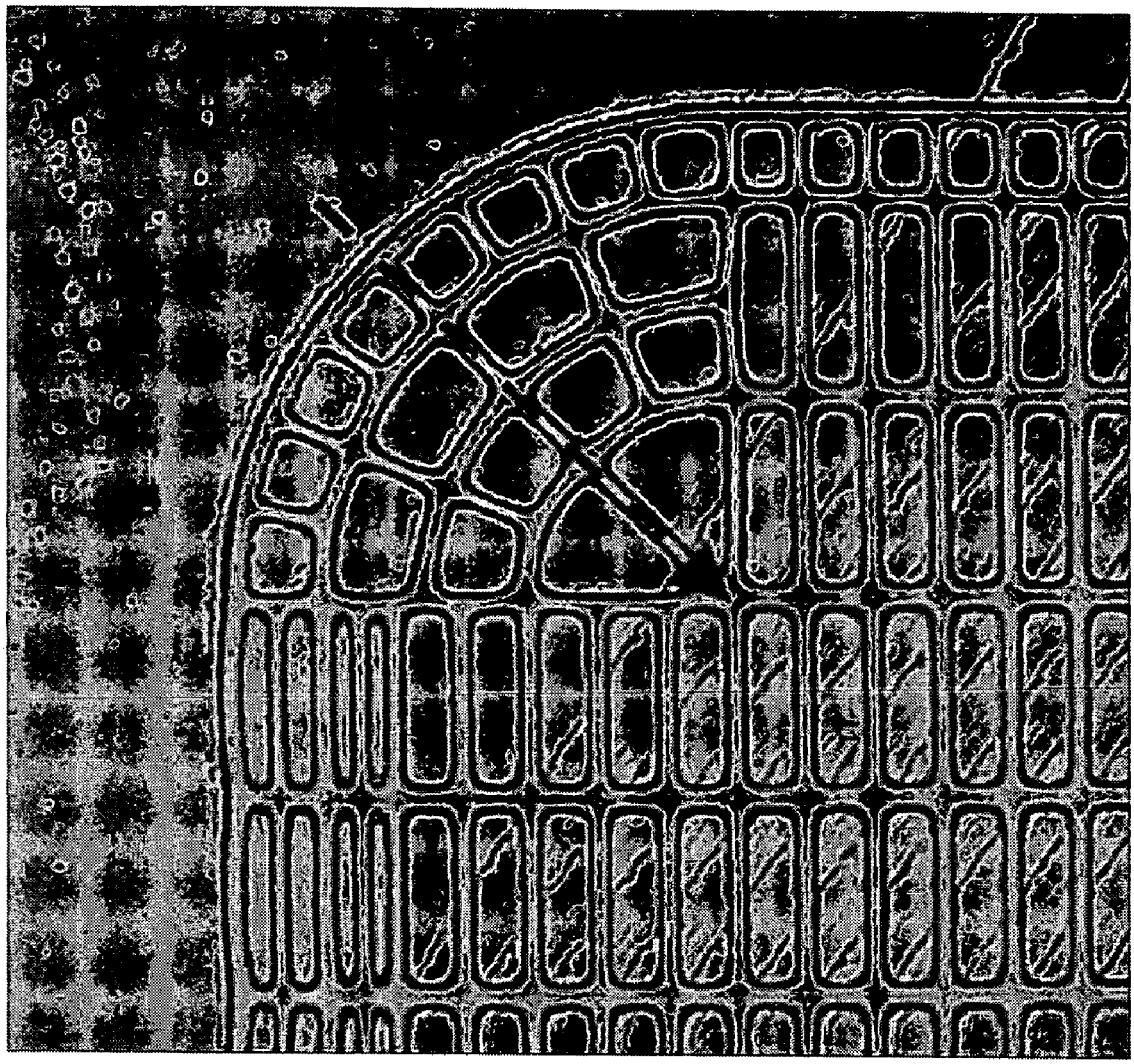
FIG. 4 illustrates an enlarged image of an exemplary dummy region employable in a corner of the exemplary PDP shown in FIG. 1.
Figure 5:
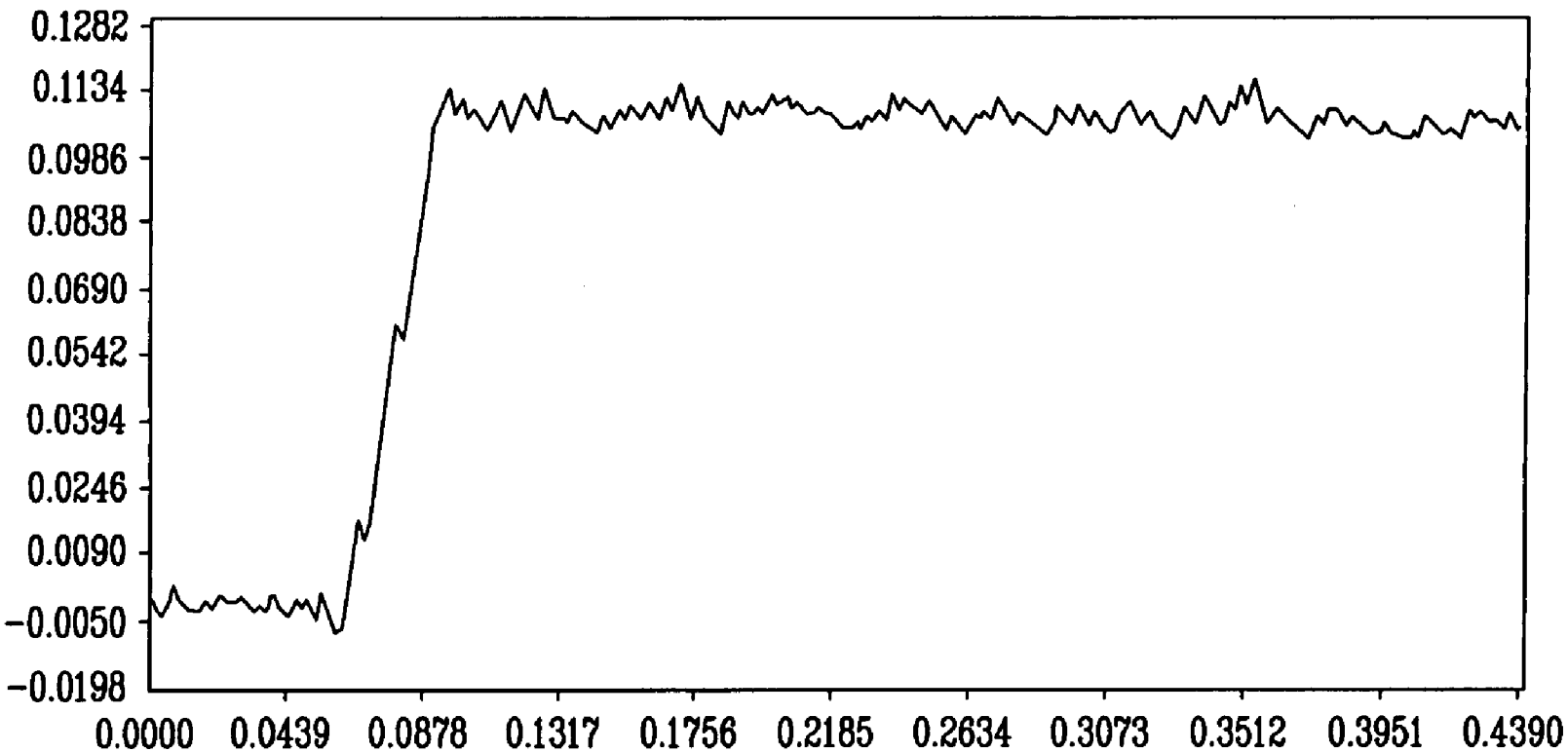
FIG. 5 illustrates a graph showing a profile of a barrier rib member formed along a direction of the arrow shown in FIG. 4.

FIG. 4 illustrates an enlarged image of a dummy region provided in a corner of the plasma display according to the exemplary embodiment of the present invention shown in FIG. 1. FIG. 5 illustrates a graph of a profile of a barrier rib member formed along an arrow direction of FIG. 4, i.e., the first sector barrier rib member. As shown in FIG. 5, the outer end of the first sector barrier rib is not bent. Thus, a height of an outer end portion of the rib relative to a substrate is similar to a height of an inner portion of the barrier rib.

Figure 6:
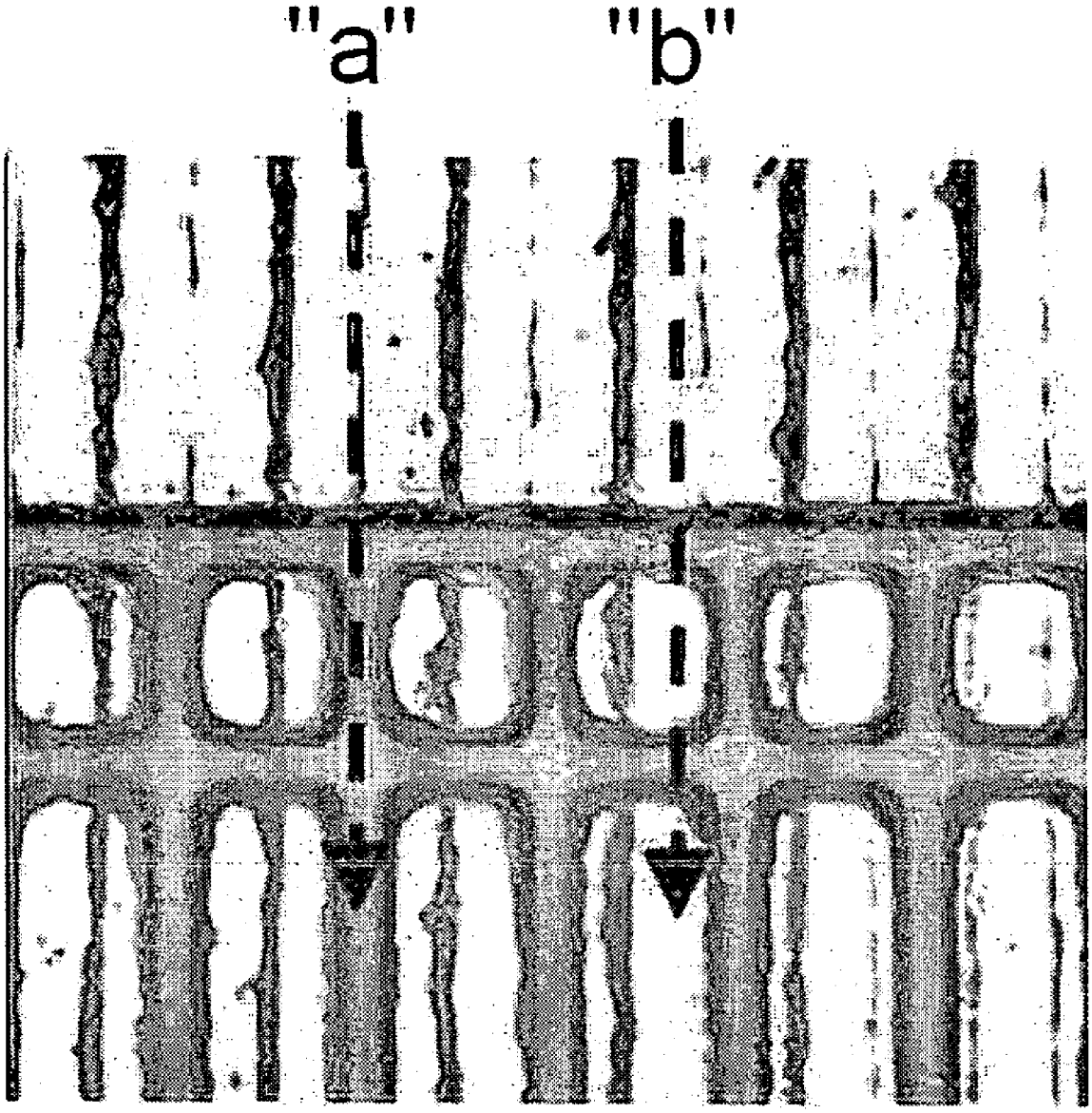
FIG. 6 illustrates an enlarged image of an outermost barrier rib member of a barrier rib in the exemplary PDP shown in FIG. 1.
Figure 7A:
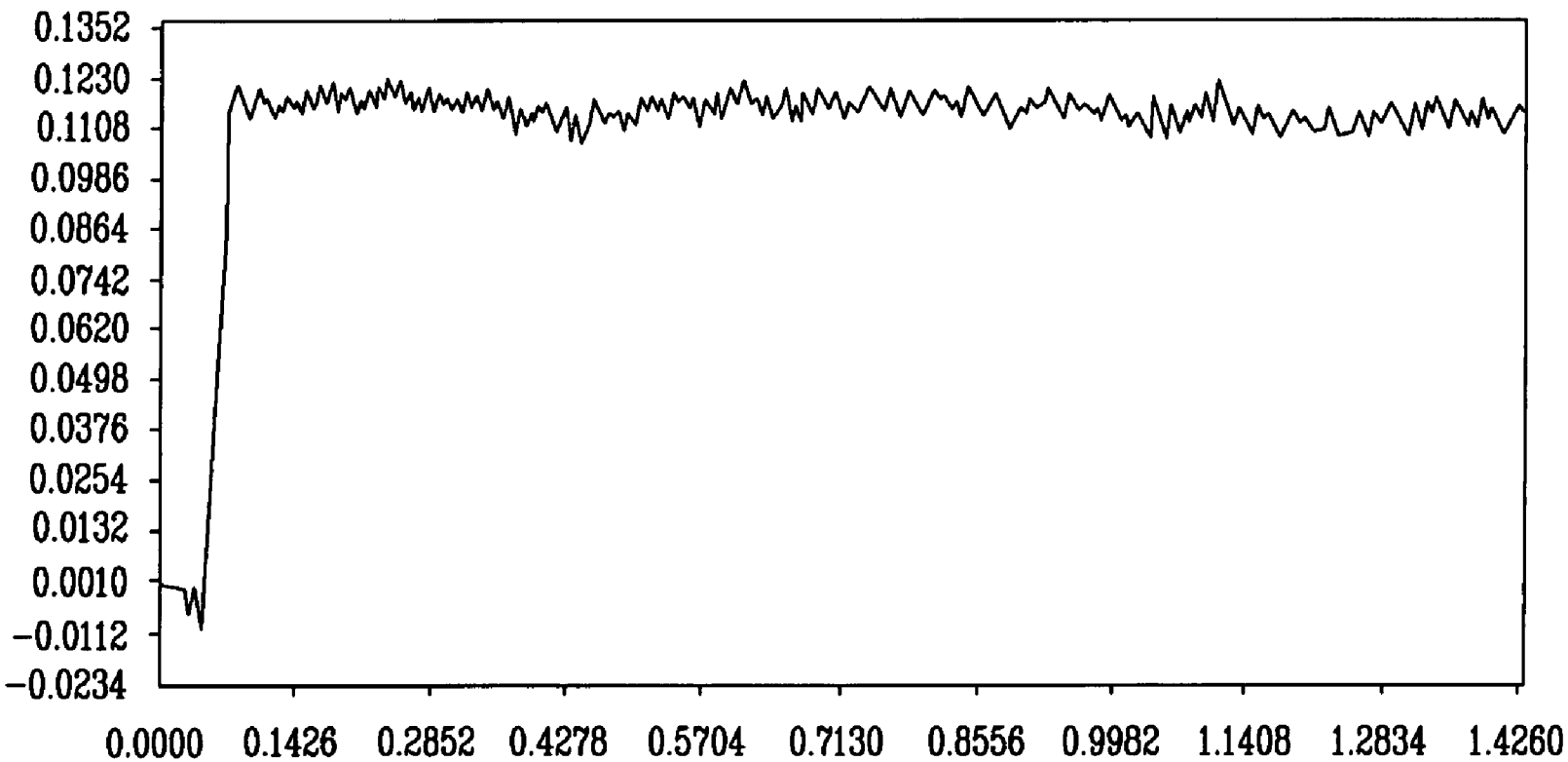
FIG. 7A and FIG. 7B illustrates graphs respectively showing profiles of the barrier ribs formed along direction "a" and direction "b" of FIG. 6.
Figure 7B:
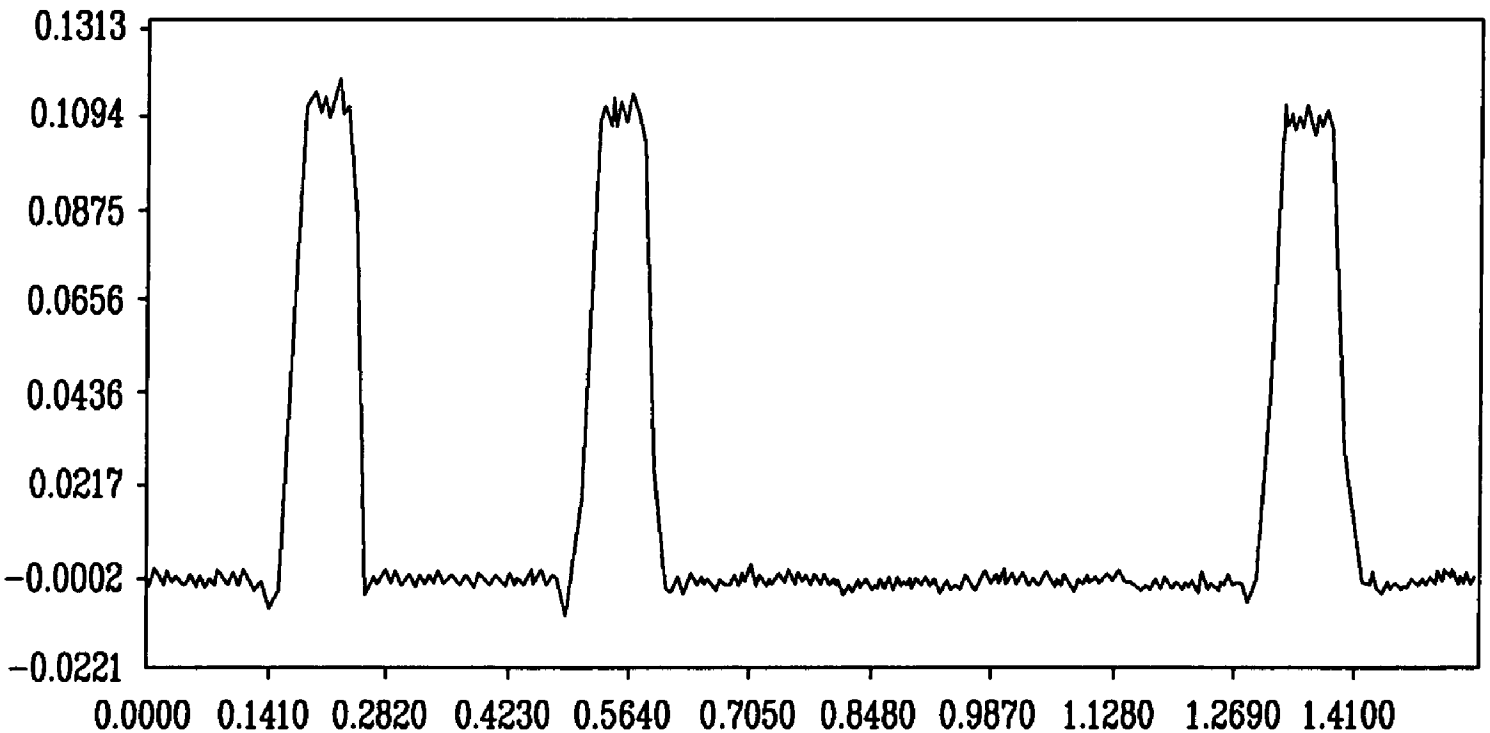
Figure 8:
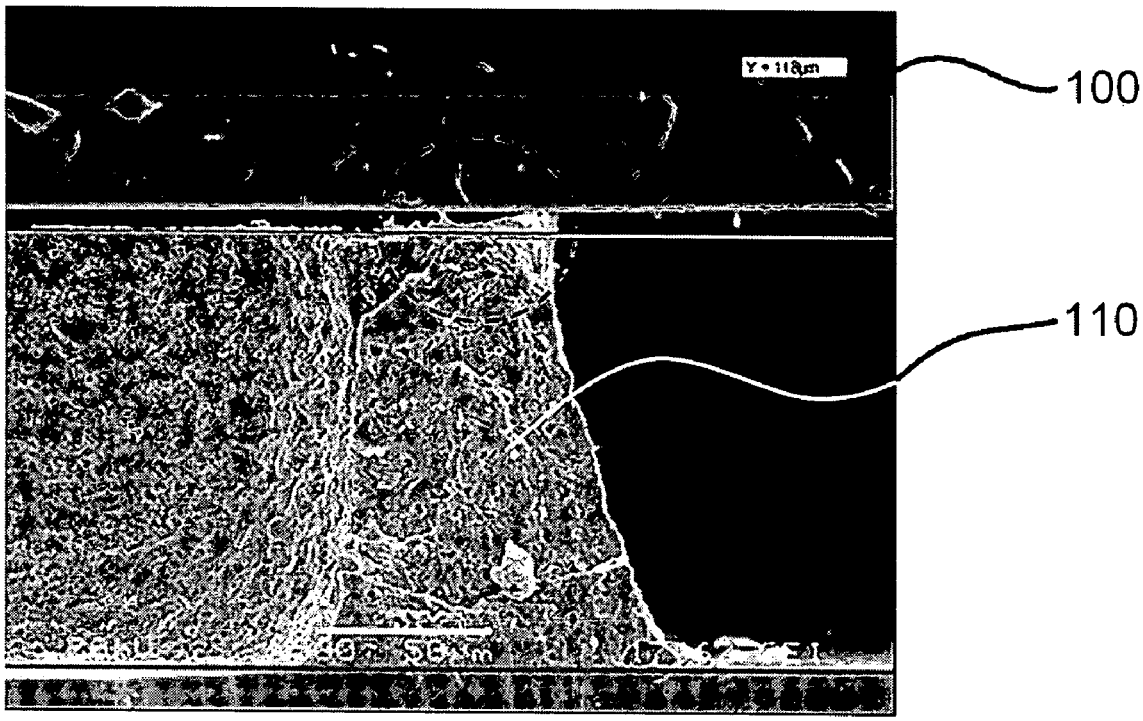
FIG. 8 illustrates a barrier rib bent at its outer end.

FIG. 6 is an image showing an enlarged view of an outermost barrier rib member of a barrier rib in the exemplary embodiment of the PDP. FIG. 7A and FIG. 7B illustrate graphs respectively showing profiles of the barrier ribs formed along the "a" direction and the "b" direction of FIG. 6. As shown in FIG. 7A and FIG. 7B, the outer end portion of the barrier rib is not bent. Thus, a height of an outer end portion of the rib relative to a substrate is similar to that of the inner portion of the barrier rib. Thus, a gap should not be formed between a top of the barrier ribs and another substrate.

In PDPs employing one or more aspects of the invention, a sector region including an outer portion may be provided in a non-display area, adjacent to first and/or second barrier rib regions to thereby reduce and/or prevent respective outer end portions of barrier ribs from bending and/or deforming as a result of shrinkage of the barrier ribs during a baking process.

One or more aspects of the invention help reduce and/or prevent end portions of barrier ribs from bending and deforming and thus, embodiments of the invention help reduce and/or prevent a gap from forming between a barrier rib and a substrate, thereby reducing and/or preventing noise during driving of the panel.

Exemplary embodiments of the present invention have been disclosed herein, and although specific terms are employed, they are used and are to be interpreted in a generic and descriptive sense only and not for purpose of limitation. Accordingly, it will be understood by those of ordinary skill in the art that various changes in form and details may be made without departing from the spirit and scope of the present invention as set forth in the following claims.

What is claimed is:

1. A plasma display panel comprising:

a front substrate and a rear substrate disposed to be facing each other;

a plurality of address electrodes and a plurality of display electrodes formed in a space between the front substrate and the rear substrate, the address electrodes and the display electrodes being arranged to cross each other;

a display area for forming an image;

a non-display area around the display area, the non-display area including a dummy region;

a plurality of barrier rib members, each barrier rib member extending across at least one of the display area and the non-display area, the plurality of barrier rib members including first barrier rib members and second barrier rib members, the first barrier rib members extending along a first direction and the second barrier rib members extending along a second direction that crosses the first direction, the first barrier rib members and the second barrier rib members partitioning the space between the front substrate and the rear substrate and defining a plurality of discharge cells in the display area and a plurality of dummy cells in the dummy region, wherein the dummy region includes:

at least one first barrier rib region extending along the first direction, the first barrier rib region including portions of at least some of the plurality of barrier rib members;

at least one second barrier rib region extending along the second direction, the second barrier rib region including portions of at least some of the plurality of barrier rib members; and at least one sector region, the sector region including at least one arc-shaped sector barrier rib member extending along a direction other than the first direction and the second direction and connecting at least one portion of at least one of the barrier rib portions in the first barrier rib region to at least one of the barrier rib portions in the second barrier rib region, the sector region further including a radial barrier rib member linearly extending from a point where the first barrier rib region and the second barrier rib region intersect to a point on a curve defining the arc-shaped sector barrier rib member.

2. The plasma display panel as claimed in claim 1, wherein the first direction is perpendicular to the second direction, and the radial barrier rib member bisects an angle formed by the intersection of the first barrier rib region and the second barrier rib region.

3. The plasma display panel as claimed in claim 1, wherein the sector region includes a plurality of arc-shaped sector barrier rib members, and a first predetermined space exists between adjacent ones of the arc-shaped sector barrier rib members.

4. The plasma display panel as claimed in claim 3, wherein the arc-shaped sector barrier rib members extend along curves formed at different predetermined distances with respect to the point where the first barrier rib region and the second barrier rib region intersect.

5. The plasma display panel as claimed in claim 3, wherein a distance between an outermost one of the arc-shaped sector barrier rib members and a first adjacent one of the plurality of arc-shaped sector barrier rib members is less than a distance between the intersection point of the first barrier rib region and the second barrier rib region and a second adjacent one of the plurality of arc-shaped barrier rib members, the first adjacent one of the plurality of arc-shaped barrier rib members being a closest one of the plurality of arc-shaped sector barrier rib members to the outermost one of the arc-shaped sector barrier rib members and the second adjacent one of the plurality of arc-shaped barrier ribs beings a closest one of the plurality of arc-shaped sector barrier rib members to the intersection of the first barrier rib region and the second barrier rib region.

6. The plasma display panel as claimed in claim 3, further comprising at least one inter-rib barrier rib member linearly extending between and connecting adjacent arc-shaped ones of the sector barrier rib members.

7. The plasma display panel as claimed in claim 6, wherein a number of inter-rib barrier rib members respectively disposed between an outermost one of the of the arc-shaped sector barrier rib members and a first adjacent one of the plurality of arc-shaped sector barrier rib members is greater than a number of inter-rib barrier rib members disposed between other respective adjacent ones of the plurality of arc-shaped sector barrier rib members.

8. The plasma display panel as claimed in claim 6, wherein a width of the inter-rib barrier rib member is less than a width of the arc-shaped sector barrier rib members.

9. The plasma display panel as claimed in claim 1, wherein each of the sector regions is defined by a first linear portion and a second linear portion and the first linear portion corresponds to where respective ends of the portions of the plurality of barrier rib members in the first barrier rib region continuously connect to an end of the at least one sector barrier rib member extending along the direction other than the first direction and the second direction and the second linear portion corresponds to where respective ends of the portions of the plurality of barrier rib members in the second barrier rib region continuously connect to another end of the at least one sector barrier rib member.

10. The plasma display panel as claimed in claim 1, wherein the arc-shaped sector barrier rib member defines an outermost edge of the sector region and is continuously connected to an outermost one of the first barrier rib members of the first barrier rib region.

11. The plasma display panel as claimed in claim 10, wherein at least one radial rib member continuously extends from at least one of the first barrier rib members and the second barrier rib members along a direction other than the first and second directions, and the radial rib member continuously linearly extends from and between the point where the first barrier rib region and the second barrier rib region intersect and the arc-shaped barrier rib member.

12. A plasma display panel comprising:

a front substrate and a rear substrate disposed to be facing each other;

a plurality of address electrodes and a plurality of display electrodes formed in a space between the front substrate and the rear substrate, the address electrodes and the display electrodes being arranged to cross each other;

a display area for forming an image;

a non-display area around the display area, the non-display area including a dummy region;

a plurality of barrier rib members, each barrier rib member extending across at least one of the display area and the non-display area, the plurality of barrier rib members including first barrier rib members and second barrier rib members, the first barrier rib members extending along a first direction and the second barrier rib members extending along a second direction that crosses the first direction, the first barrier rib members and the second barrier rib members partitioning the space between the front substrate and the rear substrate and defining a plurality of discharge cells in the display area and a plurality of dummy cells in the dummy region, wherein the dummy region includes:

at least one first barrier rib region extending along the first direction, the first barrier rib region including portions of at least some of the plurality of barrier rib members;

at least one second barrier rib region extending along the second direction, the second barrier rib region including portions of at least some of the plurality of barrier rib members; and at least one sector region, the sector region including at least one sector barrier rib member extending along a direction other than the first direction and the second direction and connecting at least one portion of at least one of the barrier rib portions in the first barrier rib region to at least one of the barrier rib portions in the second barrier rib region, wherein the first direction extends horizontally and the second direction extends vertically, and the first barrier rib region includes at least three first barrier rib members extending horizontally therein such that at least one of the first barrier rib members is provided between an outermost horizontally extending one of the plurality of first barrier rib members and an innermost horizontally extending one of the plurality of first barrier rib members, and a shortest distance exists between the outermost first barrier rib member and the first barrier rib member adjacent thereto and a greatest distance exists between the innermost first barrier rib member and the first barrier rib member adjacent thereto, in relation to respective distances between adjacent ones of the first barrier rib members.

13. The plasma display panel as claimed in claim 12, wherein a width of the outermost first barrier rib member is greater than a width of the first barrier rib member adjacent thereto.

14. The plasma display panel as claimed in claim 13, wherein a width of the second barrier rib members extending vertically in the first barrier rib region and crossing the outermost first barrier rib member is less than the width of the outermost first barrier rib member.

15. A plasma display panel comprising:

a front substrate and a rear substrate disposed to be facing each other;

a plurality of address electrodes and a plurality of display electrodes formed in a space between the front substrate and the rear substrate, the address electrodes and the display electrodes being arranged to cross each other;

a display area for forming an image;

a non-display area around the display area, the non-display area including a dummy region;

a plurality of barrier rib members, each barrier rib member extending across at least one of the display area and the non-display area, the plurality of barrier rib members including first barrier rib members and second barrier rib members, the first barrier rib members extending along a first direction and the second barrier rib members extending alone a second direction that crosses the first direction, the first barrier rib members and the second barrier rib members partitioning the space between the front substrate and the rear substrate and defining a plurality of discharge cells in the display area and a plurality of dummy cells in the dummy region, wherein the dummy region includes:

at least one first barrier rib region extending along the first direction, the first barrier rib region including portions of at least some of the plurality of barrier rib members;

at least one second barrier rib region extending along the second direction, the second barrier rib region including portions of at least some of the plurality of barrier rib members; and at least one sector region, the sector region including at least one sector barrier rib member extending along a direction other than the first direction and the second direction and connecting at least one portion of at least one of the barrier rib portions in the first barrier rib region to at least one of the barrier rib portions in the second barrier rib region, wherein the first direction extends horizontally and the second direction extends vertically, and the second barrier rib region includes at least three second barrier rib members extending vertically therein such that at least one of the second barrier rib members is provided between an outermost vertically extending one of the plurality of second barrier rib members and an innermost vertically extending one of the plurality of second barrier rib members, and a shortest distance exists between the outermost second barrier rib member and the second barrier rib member adjacent thereto and a greatest distance exists between the innermost second barrier rib member and the second barrier rib member adjacent thereto, in relation to respective distances between adjacent ones of the second barrier rib members.

16. The plasma display panel as claimed in claim 14, wherein the first barrier rib region includes at least three first barrier rib members extending horizontally therein such that at least one of the first barrier rib members is provided between an outermost horizontally extending one of the plurality of first barrier rib members and an innermost horizontally extending one of the plurality of first barrier rib members, and a shortest distance exists between the outermost first barrier rib member and the first barrier rib member adjacent thereto and a greatest distance exists between the innermost first barrier rib member and the first barrier rib member adjacent thereto, in relation to respective distances between adjacent ones of the first barrier rib members.

17. The plasma display panel as claimed in claim 15, wherein a width of the outermost vertical barrier rib member is greater than a width of the second barrier rib member adjacent thereto.

18. The plasma display panel as claimed in claim 15, wherein a width of the first barrier rib members extending horizontally in the second barrier rib region and crossing the outermost vertical barrier rib member is less than a width of the outermost second barrier rib member.

19. The plasma display panel as claimed in claim 15, wherein the at least one sector barrier rib member is an arc-shaped sector barrier rib member and an end of the arc-shaped sector barrier rib member continuously extends and connects to one of the first barrier rib members linearly extending horizontally in the first barrier rib region and another end of the arc-shaped sector barrier rib member continuously extends and connects to one of the second barrier rib members linearly extending vertically in the second barrier rib region.

* * * * *